US008883704B2

(12) United States Patent
Borchers et al.

(10) Patent No.: US 8,883,704 B2
(45) Date of Patent: Nov. 11, 2014

(54) BLEACH GRANULES

(75) Inventors: Georg Borchers, Bad Nauheim (DE); Gerd Reinhardt, Kelkheim (DE); Andreas Schottstedt, Hofheim (DE)

(73) Assignee: Clariant International Ltd., Muttenz (CH)

( * ) Notice: Subject to any disclaimer, the term of this patent is extended or adjusted under 35 U.S.C. 154(b) by 0 days.

(21) Appl. No.: 13/263,022

(22) PCT Filed: Apr. 1, 2010

(86) PCT No.: PCT/EP2010/002099

§ 371 (c)(1), (2), (4) Date: Nov. 29, 2011

(87) PCT Pub. No.: WO2010/115581

PCT Pub. Date: Oct. 14, 2010

(65) Prior Publication Data

US 2012/0094889 A1 Apr. 19, 2012

(30) Foreign Application Priority Data

Apr. 11, 2009 (DE) ..... 10 2009 017 724

(51) Int. Cl.

| | |
|---|---|
| ***C11D 3/16*** | (2006.01) |
| ***C11D 3/39*** | (2006.01) |
| ***C11D 3/395*** | (2006.01) |
| ***C11D 3/20*** | (2006.01) |

(52) U.S. Cl.

CPC ..... *C11D 3/3932* (2013.01); *C11D 3/3917* (2013.01); *C11D 3/3907* (2013.01); *C11D 3/2079* (2013.01); *C11D 3/2075* (2013.01); *C11D 3/3935* (2013.01)

USPC ..... 510/311; 510/313; 510/356; 510/361; 510/376; 510/444; 510/312; 510/475; 510/477; 510/488; 510/499; 510/505; 510/506

(58) Field of Classification Search

USPC ..... 510/311, 312, 313, 356, 361, 376, 444, 510/445, 499, 475, 477, 488, 505, 506

See application file for complete search history.

(56) References Cited

U.S. PATENT DOCUMENTS

| | | | | |
|---|---|---|---|---|
| 6,875,734 | B2 | 4/2005 | Reinhardt et al. | |
| 7,094,745 | B2 | 8/2006 | Jonas et al. | |
| 7,205,267 | B2 | 4/2007 | Reinhardt et al. | |
| 7,332,464 | B2 * | 2/2008 | Cramer et al. | 510/314 |
| 2007/0219110 | A1 * | 9/2007 | Becker et al. | 510/392 |
| 2008/0248989 | A1 * | 10/2008 | Holderbaum et al. | 510/445 |
| 2010/0234265 | A1 * | 9/2010 | Weber et al. | 510/230 |
| 2012/0058927 | A1 | 3/2012 | Borchers et al. | |

FOREIGN PATENT DOCUMENTS

| | | | |
|---|---|---|---|
| EP | 0458397 | | 11/1991 |
| EP | 0458398 | | 11/1991 |
| EP | 0530870 | | 3/1993 |
| EP | 0544440 | | 6/1993 |
| EP | 0549272 | | 6/1993 |
| EP | 0616029 | | 9/1994 |
| EP | 0710714 | | 5/1996 |
| EP | 1499702 | | 11/2003 |
| EP | 1445305 | | 8/2004 |
| EP | 1520910 | | 4/2005 |
| EP | 1557457 | | 7/2005 |
| GB | 2294705 | * | 5/1996 |
| WO | WO 95/06710 | | 3/1995 |
| WO | WO 95/06711 | | 3/1995 |
| WO | WO 96/06154 | | 2/1996 |
| WO | WO 96/06157 | | 2/1996 |
| WO | WO 03/093405 | | 11/2003 |
| WO | WO03/093405 | * | 11/2003 |
| WO | WO 2006/125517 | | 11/2006 |
| WO | WO 2008/069935 | | 6/2008 |

OTHER PUBLICATIONS

International Search Report for PCT/EP2010/002099, dated Jul. 6, 2010.

Translation of International Preliminary Report on Patentability for PCT/EP2010/0209, dated Jul. 5, 2011.

International Search Report for PCT/EP2010/002100, dated Jun. 25, 2010.

Translation of International Preliminary Report on Patentability for PCT/EP2010/0209, dated Jul. 22, 2011.

* cited by examiner

*Primary Examiner* — Gregory Delcotto

(74) *Attorney, Agent, or Firm* — Michael W. Ferrell

(57) ABSTRACT

The invention relates to co-granules containing a) at least one bleach activator, b) at least one metal-containing bleach catalyst, and c) at least 5 wt. % of at least one organic acid. The co-granules are easy to produce, have a high stability in storage and are advantageously suitable for producing cleaning products and detergents and especially products for cleaning crockery in a machine.

9 Claims, No Drawings

BLEACH GRANULES

The present invention relates to bleach granules, to a process for production thereof and to the use thereof in washing and cleaning compositions, especially in compositions for the machine washing of dishware.

In order to obtain spotless dishware, persalts such as perborates and percarbonates are used in machine dishwashing compositions. To activate these bleaches, and in order to achieve improved bleaching action when washing at temperatures of 60° C. or below, machine dishwashing compositions generally further comprise bleach activators or bleach catalysts, and the bleach catalysts in particular have been found to be especially effective.

Bleach catalysts are used in machine dishwashing compositions preferably in the form of prefabricated granules, in order to increase the storage stability thereof. For instance, EP 0 458 397, EP 0 458 398 and EP 0 530 870 describe bleach catalysts based on various manganese-containing transition metal complexes.

Processes for producing bleach catalyst granules are disclosed in EP 0 544 440, WO 95/06710 and WO 20081069935. A characteristic feature of the processes described therein is the use of large amounts of inert materials as a carrier and binders which are optionally used as melts, this procedure including cooling and/or drying stages, which require the use of additional apparatuses such as fluidized bed systems.

However, the microbicidal action of bleach catalysts is low in most cases. The performance of bleaches in machine dishwashing compositions is therefore higher when they consist of a combination of a bleach catalyst with a bleach activator. In this case, the bleaching action of the catalyst is promoted in an effective manner by the peroxycarboxylic acid formed from the activator. At the same time, the peroxycarboxylic acid makes a significant contribution to killing microbes on the dishware, improves the odor of the wash liquor and prevents the formation of a biofilm in the machine dishwasher. The combination of bleach catalysts and bleach activators is therefore advisable for enhancement of bleaching performance and ensuring hygiene in the case of use of bleaches in washing and cleaning compositions. For instance, EP 0 616 029 describes a bleach additive consisting of a dry mixture of percarbonate, TAED granules and bleach catalyst granules. In this case too, the bleach catalyst granules have only an active content of 1.2% by weight; the rest consists of carrier materials and/or binders.

However, the use of activators and catalysts in separate granules has disadvantages which can have an adverse effect on the bleaching performance. The reactions of the persalt, or of the hydrogen peroxide released therefrom, with activator and catalyst proceed in parallel. If the catalyst granules dissolve more rapidly than the activator granules, the persalt has already been used up before it can react with the activator. The corresponding situation applies in the converse case. Cogranules composed of activators and catalysts are also advantageous in order to ensure the homogeneous distribution of both components in the washing and cleaning composition, and in order to save space in the formulation. In addition, the production costs are reduced since only one cogranule need be produced instead of two different granules.

EP 1 499 702 describes cogranules consisting of a bleach catalyst, a bleach activator and optionally a coating. It is optionally possible for stabilizers such as antioxidants, reducing agents or acids to be present in amounts up to 2.5% by weight. The cogranules are characterized in that the particles have a moisture content of <0.5% by weight and a moisture absorption of not more than 0.5% by weight. In order to ensure this, the humidity in the ambient air in the course of production must be kept below 40%, preferably below 25%. This naturally gives rise to disadvantages in terms of production technology.

It was therefore an object of the present invention to provide bleach activator-bleach catalyst cogranules which feature increased storage stability and simplified producibility compared to the granules known from the prior art.

It has now been found that, surprisingly, this object is achieved and the storage stability and hence the maintenance of bleaching activity in such cogranules in washing and cleaning compositions can be enhanced when they contain at least 5% by weight, preferably at least 8% by weight and more preferably at least 10% by weight of an organic acid. At the same time, moisture absorption during storage and production is insignificant. It is also readily possible to incorporate hygroscopic components in the inventive cogranules, without any impairment of the storage stability thereof.

The present invention therefore provides cogranules which, in addition to one or more bleach activators and one or more metal-containing bleach catalysts, contain at least 5% by weight, preferably at least 8% by weight and more preferably at least 10% by weight of one or more organic acids.

Inventive cogranules which are particularly advantageous in relation to the performance and storage stability thereof and are therefore preferred are those which comprise, based on the total weight of the cogranules, a) 1 to 90% by weight of one or more bleach activators, b) 0.01 to 30% by weight of one or more metal-containing bleach catalysts, c) 5 to 30% by weight of one or more organic acids and d) 1 to 30% by weight of one or more binders which are not organic acids as per component c).

The inventive cogranules more preferably comprise, based on the total weight of the cogranules, a) 50 to 85% by weight of one or more bleach activators, b) 0.1 to 20% by weight of one or more metal-containing bleach catalysts, c) 5 to 20% by weight of one or more organic acids and d) 1 to 20% by weight of one or more binders which are not organic acids as per component c).

Bleach Activators

As bleach activators, the inventive cogranules may comprise polyacylated alkylenediamines, especially tetraacetylethylenediamine (TAED), acylated triazine derivatives, especially 1,5-diacetyl-2,4-dioxohexahydro-1,3,5-triazine (DADHT), acylated glycolurils, especially tetraacetylglycoluril (TAGU), N-acylimides, especially N-nonanoylsuccinimide (NOSI), acylated phenolsulfonates, especially n-nonanoyloxy- or n-lauroyloxybenzenesulfonate (NOBS or LOBS), acylated phenolcarboxylic acids, especially nonanoyloxy- or decanoyloxybenzoic acid (NOBA or DOBA), carboxylic anhydrides, especially phthalic anhydride, acylated polyhydric alcohols, especially triacetin, ethylene glycol diacetate and 2,5-diacetoxy-2,5-dihydrofuran, and also acylated sorbitol and mannitol or mixtures thereof (SORMAN), acylated sugar derivatives, especially pentaacetylglucose (PAG), pentaacetylfructose, tetraacetylxylose and octaacetyllactose, and also acetylated, optionally N-alkylated glucamine and gluconolactone, and/or N-acylated lactams, for example N-benzoylcaprolactam. Hydrophilically substituted acylacetals and acyllactams are likewise used with preference. In addition, it is possible to use nitrile derivatives such as n-methylmorpholinioacetonitrile methylsulfate (MMA) or cyanomorpholine (MOR) as bleach activators. It is also possible to use combinations of conventional bleach activators. Particularly preferred bleach activators are TAED and DOBA.

Bleach Catalysts

The bleach catalysts used in the context of the present invention are preferably bleach-boosting transition metal salts or complexes of manganese, of iron, of cobalt, of ruthenium, of molybdenum, of titanium or of vanadium.

In the case of use of metal salts, preference is given especially to manganese salts in the +2 or +3 oxidation states, for example manganese halides, preference being given to the chlorides, manganese sulfates, manganese salts of organic acids such as manganese acetates, manganese acetylacetonates, manganese oxalates and manganese nitrates.

Additionally preferred are complexes of iron in the II or III oxidation states and of manganese in the II, III, IV or IV oxidation states, which preferably contain one or more macrocyclic ligand(s) with the donor functions N, NR, PR, O and/or S. Preference is given to using ligands which have nitrogen donor functions.

The transition metal complexes used with preference in the inventive cogranules are preferably complexes which contain, as macromolecular ligands, 1,4,7-trimethyl-1,4,7-triazacyclononane (Me-TACN), 1,4,7-triazacyclononane (TACN), 1,5,9-trimethyl-1,5,9-triazacyclododecane (Me-TACD), 2-methyl-1,4,7-trimethyl-1,4,7-triazacyclononane (MeMeTACN) and/or 2-methyl-1,4,7-triazacyclononane (Me/TACN) or bridged ligands such as 1,2-bis-(4,7-dimethyl-1,4,7-triazacyclonono-1-yl)ethane (Me4-DTNE) or derivatives of cyclam or cyclen, such as 1,8-dimethylcyclam, 1,7-dimethylcyclen, 1,8-diethylcyclam, 1,7-diethylcyclen, 1,8-dibenzylcyclam and 1,7-dibenzylcyclen, as described, for example, in EP 0 458 397, EP 0 458 398, EP 0 549 272, WO 96/06154, WO 96/06157 or WO 2006/125517, but additionally also manganese complexes as known from EP 1 445 305, EP 1 520 910 or EP 1 557 457.

Suitable manganese complexes are, for example, $Mn^{III}2(\mu\text{-}O)_1(\mu\text{-}OAc)_2(TACN)_2](PF_6)_2$, $[Mn^{IV}{}_2(\mu\text{-}O)_3(Me\text{-}TACN)_2](PF_6)_2$, $[Mn^{IV}{}_2(\mu\text{-}O)_3(Me\text{-}TACN)_2](SO_4)$, $[Mn^{IV}{}_2(\mu\text{-}O)_3(Me\text{-}TACN)_2](OAc)_2$, $[Mn^{IV}{}_2(\mu\text{-}O)_3(Me\text{-}TACN)_2)(Cl)_2$, $[Mn^{IV}{}_2(\mu\text{-}O)_3(Me4\text{-}DTE)](PF_6)_2$, $[Mn^{IV}{}_2(\mu\text{-}O)_3(Me4\text{-}DTE)]Cl_2$, $[Mn^{IV}{}_2(\mu\text{-}O)_3(Me4\text{-}DTE)](SO_4)$, $[Mn^{IV}{}_2(\mu\text{-}O)_3(Me4\text{-}DTE)](OAc)_2$, cis-(1,4,8,11-tetraazacyclotetradecane) dichloroiron(III) chloride, trans-(1,4,8,11-tetraazacyclotetradecane)dichloroiron(III) chloride, 1,8-diethyl-1,4,8,11-tetraazacyclotetradecaneiron(II) chloride, 1,8-diethyl-1,4,8,11-tetraazacyclotetradecanemanganese(II) chloride and 1,4,8,11-tetraazacyclotetradecanemanganese (II) chloride.

Particularly preferred metal-containing bleach catalysts are selected from manganese salts and manganese complexes, preference being given in turn among the manganese salts to salts selected from manganese sulfate, manganese acetate and manganese oxalate, and among the manganese complexes in turn to complexes selected from $[Mn^{III}2(\mu\text{-}O)_1(\mu\text{-}OAc)_2(TACN)_2](PF_6)_2$, $[Mn^{IV}{}_2(\mu\text{-}O)_3(Me\text{-}TACN)_2](PR_6)_2$, $[Mn^{IV}{}_2(\mu\text{-}O)_3(Me\text{-}TACN)_2](SO_4)$, $[Mn^{IV}{}_2(\mu\text{-}O)_3(Me\text{-}TACN)_2](OAc)_2$, $[Mn^{IV}{}_2(\mu\text{-}O)_3(Me\text{-}TACN)_2](Cl)_2$, $[Mn^{IV}{}_2(\mu\text{-}O)_3(Me4\text{-}DTE)](PF_6)_2$, $[Mn^{IV}{}_2(\mu\text{-}O)_3(Me4\text{-}DTE)]Cl_2$, $[Mn^{IV}{}_2(\mu\text{-}O)_3(Me4\text{-}DTE)](SO_4)$, $[Mn^{IV}{}_2(\mu\text{-}O)_3(Me4\text{-}DTE)](OAc)_2$, cis-(1,4,8,11-tetraazacyclotetradecane) dichloroiron(III) chloride, trans-(1,4,8,11-tetraazacyclotetradecane)dichloroiron(III) chloride, 1,8-diethyl-1,4,8,11-tetraazacyclotetradecaneiron(II) chloride, 1,8-diethyl-1,4,8,11-tetraazacyclotetradecanemanganese(II) chloride and 1,4,8,11-tetraazacyclotetradecanemanganese (II) chloride.

Organic Acids

The organic acid used may be either monomeric or polymeric acids, either in the form of the free acid or in partly neutralized form. In the context of the present invention, the term "organic acid" therefore includes both the organic acids in free form and in partly neutralized form.

Preferred counterions are especially sodium ions.

Preferred organic acids are citric acid, ascorbic acid, oxalic acid, adipic acid, succinic acid, glutaric acid, malic acid, tartaric acid, maleic acid, fumaric acid, sugar acids, aminocarboxylic acids, fatty acids and mixtures thereof. Particularly preferred organic acids are oxalic acid, ascorbic acid, citric acid and fatty acids. The polymeric acids used are polymers of acrylic acid and copolymers of acrylic acid with methacrylic acid and of acrylic acid or methacrylic acid with maleic acid.

Especially preferred organic acids are citric acid, ascorbic acid and oxalic acid.

Binders

As a further constituent, the inventive cogranules preferably comprise a binder in order to ensure the integrity of the cogranules.

The binders used may preferably be substances selected from fatty acids, alcohol ethoxylates and polymers. The polymers are understood here to mean synthetic and natural polymers, and also modified polymers of natural origin.

Suitable examples include organic fatty acids having 8 to 22 carbon atoms, such as lauric acid, myristic acid, stearic acid or mixtures thereof. Additionally preferred are organic polymers. The polymers may be nonionic, anionic, cationic or amphoteric in nature. Natural polymers and modified polymers of natural origin are just as usable as synthetic polymers.

The group of the nonionic polymers used with binders with particular preference includes polyvinyl alcohols, acetalized polyvinyl alcohols, polyvinylpyrrolidones and polyalkylene glycols, especially polyethylene oxides. Preferred polyvinyl alcohols and acetalized polyvinyl alcohols have molecular weights in the range from 10 000 to 100 000 g/mol, preferably from 11 000 to 90 000 g/mol, more preferably from 12 000 to 80 000 g/mol and especially preferably from 13 000 to 70 000 g/mol. Preferred polyethylene oxides have molar masses in the range from approx. 200 to 5 000 000 g/mol, corresponding to degrees of polymerization n of approx. 5 to >100 000.

The anionic polymers used with particular preference as binders are especially homo- or copolymeric carboxylates. Preference is given to using, for example, polyacrylic acid or polymethacrylic acid, especially those having a relative molecular mass of 500 to 70 000 g/mol.

Preferred among these are polyacrylates which preferably have a molecular mass of 2 000 to 20 000 g/mol. Due to their superior solubility, preference is given in turn, from this group, to the short-chain polyacrylates which have molar masses of 2 000 to 10 000 g/mol and preferably of 3 000 to 5 000 g/mol.

Among these, preference is further given to copolymeric polycarboxylates, especially those of acrylic acid with methacrylic acid and of acrylic acid or methacrylic acid with maleic acid. Particularly suitable copolymers have been found to be those of acrylic acid with maleic acid which contain 50 to 90% by weight of acrylic acid and 50 to 10% by weight of maleic acid. The relative molecular mass thereof, based on free acids, is preferably 2 000 to 70 000 g/mol, more preferably 20 000 to 50 000 g/mol and especially preferably 30 000 to 40 000 g/mol.

To improve the water solubility, the polymers may also contain structural units originating from allylsulfonic acids, for example allyloxybenzenesulfonic acid and methallylsulfonic acid. Especially preferred are also biodegradable polymers formed from more than two different monomer units, for example those which contain structural units formed from salts of acrylic acid and of maleic acid and from vinyl alcohol or vinyl alcohol derivatives and sugar derivatives, or which contain structural units formed from salts of acrylic acid and of 2-alkylallylsulfonic acid and from sugar derivatives.

Further preferred copolymers are those which have structural units originating from acrolein and acrylic acid/acrylic salts or acrolein and vinyl acetate.

Further anionic polymers used as binders with preference are sulfo-containing polymers, especially copolymers formed from unsaturated carboxylic acids, sulfo-containing monomers and optionally further ionic or nonionic monomers.

Further preferred binders are room temperature solid $C_8$-$C_{22}$ alcohol ethoxylates, preferably $C_8$-$C_{22}$ alcohol ethoxylates with an average of 10 to 100 ethylene oxide units in the molecule, for example Genapol® T 500 from Clariant or carboxymethylcelluloses.

In a further preferred embodiment of the invention, the inventive cogranules have not been provided with a protective layer (coating).

In a further preferred embodiment of the invention, the inventive cogranules have been provided with a protective layer, as a result of which storage stability is also ensured in tableted formulations. The proportion of the protective or coating layer in the overall granules should then be at least 3% by weight, preferably at least 5% by weight, more preferably at least 7% by weight and especially preferably at least 15% by weight. The upper limit of the proportion of the protective or coating layer in the overall granules is preferably 30% by weight.

In a particularly preferred embodiment of the invention, the inventive cogranules comprise, based on the total weight of the cogranules, a) 50 to 85% by weight of a bleach activator, b) 0.1 to 20% by weight of a metal-containing bleach catalyst, c) 5 to 20% by weight of an organic acid, d) 1 to 20% by weight of a binder which is not an organic acid as per component c), and e) at least 3% by weight, preferably at least 5% by weight and more preferably from 7 to 30% by weight of a water-soluble protective layer (coating).

Optionally, it is also possible to add dyes to the inventive cogranules and then to provide the cogranules with a protective layer.

Coating Materials

The materials already used as binders can also be used as coating materials. In this case, the cogranules, after production thereof, are coated in a separate step with one or more coating materials, so as to form a homogeneous protective layer.

The substances preferred as coating materials correspond to the aforementioned preferred binders.

Dyes

In a further preferred embodiment of the invention, the inventive cogranules comprise one or more dyes. Preferred dyes, the selection of which presents no difficulty whatsoever to the person skilled in the art, possess a high storage stability and insensitivity toward the other constituents of the composition and to light, and also no marked substantivity with respect to the substances to be treated with the dye-containing compositions, for example textiles, glass, ceramic or plastic dishware, in order not to stain them.

In the selection of the dye, it must be ensured that the dyes have a high storage stability and insensitivity to light. At the same time, in the selection of suitable dyes, it should also be noted that dyes have different stabilities with respect to oxidation. It is generally the case that water-insoluble dyes are more stable to oxidation than water-soluble dyes. Depending on the solubility and hence also on the oxidation sensitivity, the concentration of the dye in the washing or cleaning compositions varies. Preference is given to dyes which can be destroyed oxidatively in the washing operation, and also to mixtures thereof with suitable blue dyes, called bluing agents. It has been found to be advantageous to use dyes which are soluble in water or at room temperature in liquid organic substances. Suitable examples are anionic dyes, for example anionic nitroso dyes.

Production of the Inventive Cogranules

For provision of the inventive cogranules, various granulating processes are possible in principle.

In a first preferred process variant, buildup granulation is effected in mixing apparatuses. In this case, the components are processed in customary mixing apparatuses which work batchwise or continuously and are generally equipped with rotating mixing elements. The mixers used may be apparatuses which work under moderate conditions, for example plowshare mixers (Lödige KM models, Drais K-T models), but also intensive mixers (e.g. Eirich, Schugi, Lödige CB models, Drais K-TT models). For mixing, all mixing variants which assure sufficient mixing of the components are conceivable. In a preferred embodiment, all components are mixed simultaneously. However, also conceivable are multistage mixing operations in which the individual components are introduced in different combinations into the overall mixture, individually or together with other additives. The sequence of low- and high-speed mixers can be switched as required. The residence times in the mixer granulation are preferably 0.5 s to 20 min, more preferably 2 s to 10 min. The granulation liquid can be pumped into the mixing apparatus via simple guide tubes. For better distribution, however, nozzle systems (one-substance or multisubstance nozzles) are also conceivable.

Depending on the granulating liquid used (solvent or molten binder), the granulation stage is followed by a drying step (for solvents) or cooling step (for melts), in order to avoid conglutination of the granules. The aftertreatment preferably takes place in a fluidized bed apparatus. Subsequently, the course and fine fractions are removed by sieving. The coarse fraction is comminuted by grinding and, just like the fine fraction, sent to a new granulation operation.

Granulation with the Aid of a Plasticizer

In a further preferred embodiment, the pulverulent constituents (bleach activator, bleach catalyst and optionally further assistant) are admixed with one or more plasticizing substances. The plasticizers can be introduced as a liquid or as a melt, preference being given in accordance with the invention to molten substances.

The liquid plasticizer is mixed intensively with the pulverulent active substance and optionally the further additives, so as to form a plastically deformable material. The mixing step can be effected in the abovementioned mixing apparatuses, but kneaders or specific extruder types (e.g. Extrud-o-mix from Hosokawa-Bepex Corp.) are also conceivable. The granulation material is subsequently pressed by means of tools through the die bores of a compression die, so as to form cylinder-shaped extrudates. Suitable apparatuses for the extrusion operation are edge-runner presses (for example from Schlüter, Salmatec, Bühler), pan grinders (for example from Amandus-Kahl) and extruders designed as a singleshaft machine (for example from Hosokawa-Bepex, Fuji-Paudal) or preferably as a twin-screw extruder (for example from Händle). The selection of the diameter of the die bore depends on the individual case and is typically in the range of 0.7-4 mm.

The emerging extrudates have to be comminuted to the desired length and particle size by a further processing step. In many cases, a length/diameter ratio of L/D=1 is desired. In the case of cylindrical granules, the particle diameter is between 0.2 and 2 mm, preferably between 0.5 and 0.8 mm; the particle length is in the range from 0.5 to 3.5 mm, ideally between 0.9 and 2.5 mm. The length and size of the granules can be adjusted, for example, by means of fixed stripping knives, rotating cutting knives, cutting wires or cutting blades. To round off the cut edges, the granules can subsequently be rounded once again in a rounder (for example from Glatt, Schlüter, Fuji-Paudal).

After the size of the granules has been adjusted, a final consolidation step is required, in which the solvent is removed or the melt is solidified. This step is typically conducted in a fluidized bed apparatus which, according to the requirements, is operated as a dryer or cooler. Subsequently, the coarse and fine fractions are removed by sieving. The coarse fraction is comminuted by grinding and, just like the fine fraction, sent to a new granulation operation.

Compaction

In a further preferred embodiment, the pulverulent active substances are optionally mixed with further, preferably solid additives and this mixture is compacted, then ground and optionally sieved into individual particle fractions. It is also possible to a certain extent (for example of 10% by weight) to additionally add liquid additives to the mixture. Examples of compacting aids are waterglass, polyethylene glycols, nonionic surfactants, anionic surfactants, polycarboxylate copolymers, modified and/or unmodified celluloses, bentonites, hectorites, saponites and/or other washing composition ingredients.

The compaction is preferably conducted on what are called roll compactors (for example from Hosokawa-Bepex, Alexanderwerk, Köppern). Through the selection of the roller profile, it is possible to obtain firstly pellets or briquettes and secondly pressed slugs. While the pressings in piece form typically only have to be removed from the fine fraction, the slugs have to be comminuted to the desired particle size in the mill. The mill types typically used are preferably gentle milling apparatuses, for example sieve and hammer mills (for example from Hosokawa-Alpine, Hosokawa-Bepex) or roll mills (for example from Bauermeister, Bühler).

The fine fraction and, if appropriate, the coarse fraction are removed from the granules thus obtained by sieving. The coarse fraction is sent back to the mill, and the fine fraction back to the compaction. For classification of the granules, it is possible to use standard sieving machines, for example tumbling sieves or vibration sieves (for example from Allgaier, Sweco, Vibra).

The primary characteristic feature of the inventive cogranules is the chemical composition thereof. Nonetheless, it has been found that the bleaching action of these cogranules can also be influenced in an advantageous manner via the influence of physical parameters, for example the particle size, the fine fraction and the bleach catalyst content of selected sieve fractions.

For this reason, preferred inventive cogranules are characterized in that the cogranules have a mean particle size between 0.1 and 1.6 mm, preferably between 0.2 and 1.2 mm and more preferably between 0.3 and 1.0 mm.

The inventive cogranules are suitable for use in all washing or cleaning compositions, and the use thereof in compositions for the machine washing of dishes has been found to be particularly advantageous.

It is assumed that the organic acid of the inventive cogranules assumes a protective function and prevents the reaction of alkaline washing composition constituents with the non-alkali-resistant and hydrolysis-sensitive bleach activators and bleach catalysts of the inventive cogranules.

The present invention therefore further provides for the use of inventive cogranules for production of washing and cleaning compositions and preferably of compositions for the machine washing of dishware.

The present invention further also provides washing and cleaning compositions, preferably compositions for the machine washing of dishware, comprising inventive cogranules.

Preferred inventive washing and cleaning compositions, especially the compositions for the machine washing of dishware, comprise the inventive cogranules in amounts between 0.1 and 10% by weight, preferably in amounts between 0.2 and 8% by weight and more preferably in amounts between 0.5 and 6% by weight.

The inventive washing and cleaning compositions, especially the compositions for the machine washing of dishware, which may be in the form of granules, of pulverulent or tableted solids or else in liquid or pasty form, may, apart from the inventive cogranules, in principle comprise all known ingredients which are customary in such compositions. The inventive washing and cleaning compositions, especially the compositions for the machine washing of dishware, may especially comprise builder substances, peroxygen compounds, enzymes, alkali carriers, surfactants, pH regulators, organic solvents and further assistants, such as glass corrosion inhibitors, silver corrosion inhibitors and foam regulators.

Particularly preferred washing and cleaning compositions, especially compositions for the machine washing of dishware, comprise f) 15 to 65% by weight, preferably 20 to 60% by weight, of a water-soluble builder component, g) 5 to 25% by weight, preferably 8 to 17% by weight, of a peroxygen compound, and h) 0.5 to 6% by weight of inventive cogranules, based in each case on the overall composition. Such a composition especially has a low level of alkalinity, which means that the one percent by weight solution thereof has a pH of 8 to 11.5 and preferably of 9 to 11.

Water-Soluble Builder Component or Builder Substances

Useful water-soluble builder components in the inventive washing and cleaning compositions, especially the compositions for the machine washing of dishware, in principle include all builders used customarily in such compositions, for example alkali metal phosphates, which may be present in the form of the alkaline, neutral or acidic sodium or potassium salts thereof. Examples thereof are trisodium phosphate, tetrasodium diphosphate, disodium dihydrogendisphosphate, pentasodium triphosphate, what is called sodium hexametaphosphate, and the corresponding potassium salts or mixtures of sodium and potassium salts. The amounts thereof may be in the range of up to about 60% by weight, preferably of 5 to 20% by weight, based on the overall composition. Further possible water-soluble builder components are, in addition to polyphosphonates and phosphonatoalkyi carboxylates, for example, organic polymers of native or synthetic origin of the polycarboxylate type, which act as cobuilders especially in hard water regions. Useful examples include polyacrylic acids and copolymers of maleic anhydride and acrylic acid, and the sodium salts of these polymer acids. Commercial products are, for example, Sokalan™ CP 5, CP 10 and PA 30 from BASF. The polymers of native origin usable as cobuilders include, for example, oxidized starch and polyamino acids such as polyglutamic acid or polyaspartic acid. Further possible water-soluble builder components are naturally occurring hydrocarboxylic acids, for example mono-, dihydroxysuccinic acid, alpha-hydroxypropionic acid and gluconic acid. The preferred organic water-soluble builder components include the salts of citric acid, especially sodium citrate. Useful sodium citrate includes anhydrous trisodium citrate and preferably trisodium citrate dihydrate. Trisodium citrate dihydrate can be used as a fine or coarse crystalline powder. Depending on the pH ultimately established in the inventive washing and cleaning compositions, especially the compositions for the machine washing of dishware, the acids corresponding to the cobuilder salts mentioned may also be present.

Peroxygen Compounds

Preferred peroxygen compounds are perborates and percarbonates, especially the corresponding sodium salts of these compounds.

Enzymes

The enzymes optionally present in inventive washing and cleaning compositions, especially the compositions for the machine washing of dishware, include proteases, amylases, pullulanases, cutinases and/or lipases, for example proteases such as BLAP™, Optimase™, Opticlean™, Maxacal™, Maxapem™, Durazym™, Purafect™ OxP, Esperase™ and/or Savinase™, amylases such as Termamyl™, Amylase-LT™, Maxamyl™, Duramyl™ and/or lipases such as Lipolase™, Lipomax™, Lumafast™ and/or Lipozym™. The enzymes used may be adsorbed onto carrier substances and/or embedded into coating substances in order to protect them from premature inactivation. They are present in the inventive washing and cleaning compositions, especially the compositions for the machine washing of dishware, preferably in amounts up to 10% by weight and more preferably in amounts of 0.05 to 5% by weight, particular preference being given to using enzymes stabilized against oxidative degradation.

Alkali Carriers

The inventive washing and cleaning compositions, especially the compositions for the machine washing of dishware, preferably comprise the customary alkali carriers, for example alkali metal silicates, alkali metal carbonates and/or alkali metal hydrogencarbonates. The alkali carriers typically used include carbonates, hydrogencarbonates and alkali metal silicates with a molar $SiO_2/M_2O$ ratio (M=alkali metal atom) of 1:1 to 2.5:1. Alkali metal silicates may be present in amounts of up to 40% by weight, especially 3 to 30% by weight, based on the overall composition. The alkali carrier system used with preference in the inventive washing and cleaning compositions, especially in the compositions for the machine washing of dishware, is a mixture of carbonate and hydrogen carbonate, preferably sodium carbonate and hydrogencarbonate, which may be present in amounts up to 50% by weight and preferably of 5 to 40% by weight.

In a further preferred embodiment of the invention, 20 to 60% by weight of water-soluble organic builder, especially alkali metal citrate, 3 to 20% by weight of alkali metal carbonate and 3 to 40% by weight of alkali metal disilicate are present in the inventive washing and cleaning compositions, especially the compositions for the machine washing of dishware.

Surfactants

It is optionally also possible to add to the inventive washing and cleaning compositions, especially to the compositions for the machine washing of dishware, surfactants, especially anionic surfactants, zwitterionic surfactants and preferably low-foaming nonionic surfactants, which serve for better detachment of greasy stains, as wetting agents, and possibly as granulating aids in the course of production of these compositions. The amount thereof may be up to 20% by weight, preferably up to 10% by weight, and is more preferably in the range from 0.5 to 5% by weight. Typically, extremely low-foaming compounds are used, especially in compositions for the machine washing of dishware. These preferably include $C_{12}$-$C_{18}$-alkyl polyethylene glycol-polypropylene glycol ethers having in each case up to 8 mol of ethylene oxide and propylene oxide units in the molecule. However, it is also possible to use other known low-foaming nonionic surfactants, for example $C_{12}$-$C_{18}$-alkyl polyethylene glycol-polybutylene glycol ethers having in each case up to 8 mol of ethylene oxide and butylene oxide units in the molecule, end group-capped alkyl polyalkylene glycol mixed ethers, and the foaming but ecologically attractive $C_8$-$C_{14}$-alkyl polyglucosides with a degree of polymerization of about 1 to 4 and/or $C_{12}$-$C_{18}$-alkyl polyethylene glycols with 3 to 8 ethylene oxide units in the molecule. Likewise suitable are surfactants from the family of the glucamides, for example alkyl N-methylglucamides in which the alkyl moiety preferably originates from a fatty alcohol with the carbon chain length $C_6$-$C_{14}$. It is advantageous in some cases when the surfactants described are used as mixtures, for example the combination of alkyl polyglycoside with fatty alcohol ethoxylates or of glucamide with alkyl polyglycosides. The presence of amine oxides, betanes and ethoxylated alkylamines is also possible.

pH Regulators

To establish a desired pH which does not result automatically from the mixing of the other components, the inventive washing and cleaning compositions, especially the compositions for the machine washing of dishware, may comprise system-compatible and environmentally compatible acids, especially citric acid, acetic acid, tartaric acid, malic acid, lactic acid, glycolic acid, succinic acid, glutaric acid and/or adipic acid, but also mineral acids, especially sulfuric acid or alkali metal hydrogensulfates, or bases, especially ammonium hydroxides or alkali metal hydroxides. Such pH regulators are present in the inventive washing and cleaning compositions, especially the compositions for the machine washing of dishware, preferably in an amount not exceeding 10% by weight and more preferably of 0.5 to 6% by weight.

Organic Solvents

The organic solvents usable in the inventive washing and cleaning compositions, especially the compositions for the machine washing of dishware, especially when they are present in the liquid or pasty form, include alcohols having 1 to 4 carbon atoms, especially methanol, ethanol, isopropyl and tert-butanol, diols having 2 to 4 carbon atoms, especially ethylene glycol and propylene glycol, and the mixtures thereof and the ethers derivable from the compound classes mentioned. Such water-miscible solvents are present in the inventive washing and cleaning compositions, especially in the compositions for the machine washing of dishware, preferably in an amount not exceeding 20% by weight and more preferably of 1 to 15% by weight.

Glass Corrosion Inhibitors

In order to prevent glass corrosion during the rinse cycle, it is possible for appropriate inhibitors to be used in the inventive washing and cleaning compositions, especially the compositions for the machine washing of dishware. Particularly advantageous here are crystalline sheet silicates and/or zinc salts. The crystalline sheet silicates are sold, for example, by Clariant under the Na-SKS trade name, e.g. Na-SKS-1 ($Na_2Si_{22}O_{45}.xH_2O$, kenyaite), Na-SKS-2 ($Na_2Si_{14}O_{29}.xH_2O$, magadiite), Na-SKS-3 ($Na_2Si_8O_{17}.xH_2O$) or Na-SKS-4 ($Na_2Si_4O_9.xH_2O$, makatite). Among these, Na-SKS-5 (alpha-$Na_2Si_2O_5$), Na-SKS-7 (beta-$Na_2Si_2O_5$, natrosilite), Na-SKS-9 ($NaHSi_2O_5.H_2O$), Na-SKS-10 ($NaHSi_2O_5.3H_2O$, kanemite), Na-SKS-11 (t-$Na_2Si_2O_5$) and Na-SKS-13 ($NaHSi_2O_5$) are suitable, but especially Na-SKS-6 (delta-$Na_2Si_2O_5$). An overview of crystalline sheet silicates can be found, for example, in the article published in "Seifen-Öle-Fette-Wachse, 116 Jahrgang, No. 20/1990", on pages 805-808.

In a further preferred embodiment of the invention, the inventive washing and cleaning compositions, especially the compositions for the machine washing of dishware, have an amount of the crystalline sheet silicate of preferably 0.1 to 20% by weight, more preferably 0.2 to 15% by weight and especially preferably 0.4 to 10% by weight, based in each case on the total weight of these compositions.

To suppress glass corrosion, inventive washing and cleaning compositions, especially compositions for the machine washing of dishware, may comprise at least one zinc or bismuth salt, preferably selected from the group of the organic zinc salts, more preferably selected from the group of the soluble organic zinc salts, especially preferably selected from the group of the soluble zinc salts of monomeric or polymeric organic acids, and exceptionally preferably selected from the group of zinc acetate, zinc acetylacetonate, zinc benzoate, zinc formate, zinc lactate, zinc gluconate, zinc oxalate, zinc ricinoleate, zinc abietate, zinc valerate and zinc p-toluenesulfonate. Alternatively or in combination with these zinc salts, it is possible to use bismuth salts, for example bismuth acetates.

Preferred inventive washing and cleaning compositions, especially compositions for the machine washing of dishware, in the context of the present invention are those in which the amount of the zinc salt, based on the total weight of this composition, is 0.1 to 10% by weight, preferably 0.2 to 7% by weight and more preferably 0.4 to 4% by weight, irrespective of which zinc salts are used, i.e. irrespective of whether organic or inorganic zinc salts, soluble or insoluble zinc salts, or mixtures thereof are used.

Silver Corrosion Inhibitors

In order to bring about protection from silver corrosion, silver corrosion inhibitors can be used in inventive washing and cleaning compositions, especially compositions for the machine washing of dishware. Preferred silver corrosion inhibitors are organic sulfides such as cystine and cysteine, di- or trihydric phenols, optionally alkyl- or aryl-substituted triazoles such as benzotriazole, isocyanuric acid, salts and/or complexes of titanium, zirconium, hafnium, cobalt or cerium in which the metals mentioned, according to the metal, are present in one of the oxidation states II, III, IV, V or VI.

Foam Regulators

When the inventive washing and cleaning compositions, especially the compositions for the machine washing of dishware, foam too much in use, for example in the presence of anionic surfactants, it is possible to add thereto up to 6% by weight, preferably about 0.5 to 4% by weight, of a foam-suppressing compound, preferably from the group of the silicone oils, mixtures of silicone oil and hydrophobized silica, paraffins, paraffin-alcohol combinations, hydrophobized silica, the bis fatty acid amides and other further known commercially available defoamers.

The inventive washing and cleaning compositions, especially the compositions for the machine washing of dishware, may comprise, as further ingredients, for example, the following ingredients which are known for such compositions from the prior art: sequestrants, electrolytes, additional peroxygen activators, dyes or fragrances, for example perfume oils.

Production of the Inventive Washing and Cleaning Compositions

The production of the inventive solid washing and cleaning compositions, especially of the compositions for the machine washing of dishware, does not present any difficulties and can be effected in a manner known in principle, for example by spray drying or granulation, and peroxygen compound and inventive cogranules are optionally added separately at a later stage.

Inventive washing and cleaning compositions in the form of aqueous solutions or solutions containing other customary solvents, especially corresponding compositions for the machine washing of dishware, are particularly advantageously produced by simple mixing of the ingredients, which can be added in substance or as a solution to an automatic mixer.

The inventive washing and cleaning compositions, especially compositions for the machine washing of dishware, are preferably in the form of pulverulent, granular or tableted formulations, which can be produced in a manner known per se, for example by mixing, granulation, roller compaction and/or spray drying of the thermally stressable components, and addition of the more sensitive components, which include especially enzymes, bleaches and the bleach catalysts.

To produce inventive washing and cleaning compositions, especially compositions for the machine washing of dishware, in tablet form, the procedure is preferably to mix all constituents in a mixer and to press the mixture by means of conventional tableting presses, for example eccentric presses or rotary presses, with pressures in the range from $200\text{-}10^5$ Pa to $1500\text{-}10^5$ Pa.

This affords, without any problem, fracture-resistant tablets which nevertheless have sufficiently rapid solubility under use conditions and which have flexural strengths of normally above 150 N. A tablet produced in such a way preferably has a weight of 15 to 40 g, especially of 20 to 30 g, with a diameter of 35 to 40 mm.

Inventive washing and cleaning compositions in the form of nondusting powders and/or granules with storage-stable free flow and high bulk densities in the range from 800 to 1000 g/l, especially corresponding inventive compositions for the machine washing of dishware, can be produced by, in a first process stage, mixing the builder components with at least a proportion of liquid mixture components while increasing the bulk density of this premixture, and then—if desired after intermediate drying—combining the further constituents of the composition, including the inventive cogranules, with the premixture thus obtained.

Inventive compositions for the machine washing of dishware can be used either in domestic machine dishwashers or in commercial machine dishwashers. The addition is effected manually or by means of suitable metering devices. The use concentration in the wash liquor is generally about 1 to 8 g/l, preferably 2 to 5 g/l.

A machine wash program is generally supplemented and ended by a few intermediate rinse cycles with clear water which follow the cleaning cycle, and a rinse cycle with conventional rinse aid. After drying, in the case of use of inventive compositions, completely clean dishware which is impeccable from a hygienic point of view is obtained.

EXAMPLES

In the examples which follow, percentages mean percent by weight (% by weight), unless explicitly stated otherwise.

With regard to the relative air humidities reported, the percentages have the usual meaning.

Example 1

Preparation of TAED Metal Salt Cogranules

These are cogranules comprising TAED (tetraacetylethylenediamine, bleach activator) and metal salt (bleach catalyst), for example Mn(II) sulfate. In addition, the cogranules comprise the granulating aids required (especially the binder) and the organic acid. The cogranules are produced in customary laboratory equipment with exposed handling without any particular measures to control air humidity. Comparative example D was produced according to the details in EP 1 499 702.

The two active substances, TAED and metal salt, and the organic acid and any further additives are initially charged in a laboratory mixer according to the active ingredient ratio desired, mixed and heated to the required start temperature of T>40° C. Subsequently, while stirring vigorously, the molten binder Genapol® T500 (fatty alcohol polyglycol ether, commercial product from Clariant based on a cetearyl alcohol with an average of 50 ethylene oxide units in the molecule) is metered in with a temperature of T=70-75° C. Granulation of the mixture continues for a few minutes, then it is cooled to room temperature and coarse and fine fractions are removed by sieving off at 200-1 600 μm.

In the case of cogranule specimen B, the still-warm product mixture was processed by means of an edge-runner press (Schlüter PP 085) to give cylinder granules with a diameter of D=1 mm.

Table 1 shows an overview of the cogranules produced, which were provided for storage stability tests.

TABLE 1

TAED-bleach cogranules

| Cogranules | A inventive | B inventive | C inventive | D comparative |
|---|---|---|---|---|
| Substances | | | | |
| Bleach activator | TAED | TAED | TAED | TAED |
| Bleach catalyst | Mn(II) sulfate | Mn(II) sulfate | Mn(II) sulfate | Mn(II) sulfate |
| Bleach activator: bleach catalyst | 8:1 | 8:1 | 8:1 | 8:1 |
| Binder | Genapol ® T 500 | Genapol ® T 500 | Genapol ® T 500 | Genapol ® T 500 |
| Organic acid | oxalic acid | ascorbic acid | citric acid | — |
| Composition | | | | |
| Bleach activator % | 68.57 | 68.57 | 69.57 | 76.68 |
| Bleach catalyst % | 8.57 | 8.57 | 8.70 | 9.58 |
| Binder % | 14.29 | 14.29 | 13.00 | 13.74 |
| Organic acid % | 8.57 | 8.57 | 8.73 | — |

Hygroscopicity Test—Physical Stability

To test the physical stability of the inventive cogranules, the hygroscopic character is tested at elevated relative air humidity. For this purpose, the cogranules are stored exposed at a relative air humidity of 65% and room temperature over several hours. Over the experimental period, the moisture absorption is registered by means of a balance and the outward change in the sample is observed. On completion of the storage test, in addition to the increasing weight, the flowability, or to be more precise the degree of caking, is assessed by scores (score 1: very good, free-flowing to score 6: completely caked, no longer free-flowing).

Table 2 shows the results of the hygroscopicity test for the above-described cogranules.

TABLE 2

Hygroscopicity test

| Cogranules | A inventive | B inventive | C inventive | D comparative |
|---|---|---|---|---|
| Hygroscopicity-65% RH | | | | |
| Moisture absorption % | 5.1 | 3.3 | 1.1 | 0.9 |
| Score (flowability) | 3 | 2 | 2 | 2 |
| Cogranule assessment | acceptable | good | good | good |

RH: relative air humidity

The results show that the cogranules, in spite of a noticeable absorption of moisture of about 1%, remain free-flowing and do not cake under the action of elevated air humidity.

Storage Test in Washing Powder Base—Chemical Storage Stability

To test the physical stability of the inventive cogranules, the storage performance in a typical washing powder formulation is studied. For this purpose, the cogranules are incorporated into IEC-A washing powder base, such that the finished formulation contains 5% cogranules. The mixtures are subsequently stored under ambient conditions and more severe climatic conditions (T=40° C., 75% relative air humidity) over several days. At regular intervals, the samples are assessed with regard to the discoloration of the cogranules and scored (score 1: very good, no discoloration to score 6: severe discoloration, very dark color).

Table 3 shows the results of the storage test in washing powder base for the above-described cogranules.

TABLE 3

Storage test in washing powder base

| Cogranules | A inventive | B inventive | C inventive | D comparative |
|---|---|---|---|---|
| Storage time Ambient conditions [days] | 7 | 7 | 7 | 7 |
| Score (discoloration) | 1 | 1 | 1 | 1 |
| Sample assessment | very good | very good | very good | very good |
| Storage time 40° C., 75% RH [days] | 7 | 7 | 7 | 7 |
| Score (discoloration) | 2 | 2 | 2 | 6 |
| Sample assessment | good | good | good | very poor |

RH: relative air humidity

The results show that all cogranules studied first of all have very good storage stability under ambient conditions. In the case of the more severe ambient storage conditions, comparative specimen D without addition of a stabilizer (i.e. of an organic acid) exhibited very poor stability with severe discoloration of the cogranules. In contrast, all three specimens A-C with addition of a stabilizing acid had significantly better storage stability, such that no impairment resulting from a change in color of the cogranules was detectable on completion of the storage test.

The results of the storage tests show that the inventive cogranules have better storage stability than the comparative product, even though they have a higher hygroscopicity.

Example 2

Production of TAED Metal Salt Cogranules

These are cogranules comprising TAED (bleach activator) and a bleach catalyst, for example Mn (II) acetate. In addition, the cogranules contain the granulating aids required, with or without further additives. The cogranules were produced in customary laboratory equipment with exposed handling without any particular measures to control air humidity. The composition of the specimens is shown in table 4.

In the case of specimen E, the two active substances, TAED and bleach catalyst, and the carboxymethylcellulose (CNC) binder, are initially charged in a laboratory mixer in accordance with the active ingredient ratio desired, and mixed. Subsequently, water is metered in with vigorous stirring and the mixture is granulated. The moist cogranules are in a laboratory fluidized bed dryer at approx. 60-80° C. and then sieved off to remove coarse and fine fractions at 200-1600 μm.

In the case of specimen F, instead of the carboxymethylcellulose, an aqueous solution of the acidic polymer Sokalan CP 45 (polyacrylate, sodium salt, commercial product from BASF; partially neutralized), to which a dye had been added, was used.

TABLE 4

TAED-bleach cogranules

| Cogranules | E comparative | F inventive |
|---|---|---|
| Substances | | |
| Bleach activator | TAED | TAED |
| Bleach catalyst | Mn(II) acetate | Mn(II) acetate |
| Bleach activator: bleach catalyst | 4.8:1 | 4:1 |
| Binder | CMC | — |
| Organic acid and binder | — | Sokalan CP 45 |
| Composition | | |
| Bleach activator % | 74.0 | 58.0 |
| Bleach catalyst % | 15.5 | 17.0 |
| Binder % | 7.5 | — |
| Organic acid and binder % | — | 15.0 |

Qualitative Storage Test to Assess Storage Stability

The two cogranules from table 4 were spread out on Petri dishes and stored exposed under ambient conditions over a few days. The storage conditions selected were T=40° C. and approx. 75% relative air humidity. After the storage time had elapsed, the cogranules were assessed for discoloration, flowability, or to be more precise degree of caking, and moisture absorption, and scored (score 1: very good, no discoloration, free-flowing to score 6: severe discoloration, caked).

Table 5 shows the results of the storage test for the above-described cogranules

TABLE 5

Open storage of cogranules

| Cogranules | E comparative | F inventive |
|---|---|---|
| Moisture absorption % | 0.9 | 1.3 |
| Score (flowability) | 2 | 2 |
| Cogranule assessment | good | good |
| Storage time at 40° C., 75% RH (days) | 3 | 3 |
| Score (discoloration) | 6 | 3 |
| Cogranule assessment | very poor | acceptable |

RH: relative air humidity

With regard to caking tendency, both cogranules had good storage properties and remained free-flowing after the storage test.

With regard to the chemical storage stability, the results show that addition of the acidic additive (Sokalan CP 45) even under very drastic storage conditions achieved stabilization of the TAED-metal salt cogranules. In contrast, unacceptable discoloration was observed for the unstabilized cogranules.

Example 3

Production of TAED-Metal Complex Cogranules

The two active substances, TAED (bleach activator) and metal complex (bleach catalyst), and also the organic acid, with or without further additives, are initially charged in a laboratory mixer according to the active ingredient ratio desired, mixed and heated to the required start temperature of T>40° C. Subsequently, while stirring vigorously, the molten binder Genapol® T 500 (fatty alcohol polyglycol ether, commercial product from Clariant) is metered in with a temperature of T=70-75° C. Granulation of the mixture continues for a few minutes, then it is cooled to room temperature and coarse and fine fractions are removed by sieving off at 200-1600 μm.

The still-warm product mixture is processed by means of an edge-runner press (Schlüter PP 085) to give cylinder granules with a diameter D=1 mm.

TABLE 6 shows an overview of the inventive cogranules G, H, I and J

| Cogranules | G | H | I | J |
|---|---|---|---|---|
| Substances | | | | |
| Bleach activator | TAED | DOBA | TAED | TAED |
| Bleach catalyst | complex 1 | complex 1 | complex 2 | complex 3 |
| Bleach activator: bleach catalyst | 10:1 | 10:1 | 10:1 | 10:1 |
| Binder | Genapol ® T500 | Genapol ® T500 | Genapol ® T500 | Genapol ® T500 |
| Organic acid | oxalic acid | ascorbic acid | citric acid | oxalic acid |
| Composition | | | | |
| Bleach activator % | 70.6 | 70.25 | 70 | 70.40 |
| Bleach catalyst % | 7.06 | 7.02 | 7 | 7.04 |
| Binder % | 13.8 | 14.1 | 14.3 | 13.91 |
| Organic acid % | 8.54 | 8.63 | 8.7 | 8.65 |

TAED tetraacetylethylenediamine

DOBA decanoyloxybenzoic acid

Complex 1 $[Mn^{IV}_2(\mu\text{-}O)_3(Me\text{-}TACN)_2](PF_6)_2$, prepared according to EP 0 458 397

Complex 2 $[Mn^{IV}_2(\mu\text{-}O)_3(Me\text{-}TACN)_2](OAc)_2$, prepared according to WO 2006/125517

Complex 3 1,8-diethyl-1,4,8,11-tetraazacyclotetradecanemanganese(II) chloride, prepared according to EP 1 557 457.

In the storage test according to example 1, cogranules G, H, I and J have very good storage stability.

The invention claimed is:

1. A cogranule comprising, based on the total weight of the cogranule, a) 50 to 85% by weight of a bleach activator, b) 0.1 to 20% by weight of at least one metal-containing bleach catalyst, wherein the at least one metal-containing bleach catalyst is selected from the group consisting of manganese salts and manganese complexes, c) 8 to 20% by weight of at least one organic acid selected from the group consisting of citric acid, ascorbic acid and oxalic acid and d) 1 to 20% by weight of at least one binder which is not the at least one organic acid as per component c), with the further requirement that the bleach activator in the cogranule consists of either (i) tetraacetylethylenediamine only or (ii) decanoyloxybenzoic acid only.

2. A cogranule as claimed in claim 1, wherein the at least one binder is selected from the group consisting of fatty acids, alcohol ethoxylates and polymers.

3. A process for producing a washing and cleaning composition comprising the step of adding a cogranule as claimed in claim 1 to the washing and cleaning composition.

4. A process for producing a composition for the machine washing of dishware comprising the step of adding a cogranule as claimed in claim 1 to the composition for the machine washing of dishware.

5. A cogranule as claimed in claim 1, wherein the metal containing bleach catalyst is selected from manganese sulfate, manganese acetate and manganese oxalate.

6. A cogranule as claimed in claim 5, wherein the at least one binder is selected from the group consisting of fatty acids, alcohol ethoxylates and polymers.

7. A cogranule as claimed in claim 1, wherein the cogranule absorbs moisture in an amount of about 1% by weight to 5.1% by weight of at least 1%.

8. A cogranule as claimed in claim 1, wherein the bleach catalyst is selected from the group consisting of: manganese sulfate; manganese acetate; manganese oxalate; $[Mn^{III}2(\mu\text{-}O)_1\ (\mu\text{-}OAc)_2(TACN)_2](PF_6)_2$; $[Mn^{IV}{}_2(\mu\text{-}O)_3(Me\text{-}TACN)_2](PF_6)_2$; $[Mn^{IV}{}_2(\mu\text{-}O)_3(Me\text{-}TACN)_2](SO_4)$; $[Mn^{IV}{}_2(\mu\text{-}O)_3(Me\text{-}TACN)_2](OAc)_2$; $[Mn^{IV}{}_2(\mu\text{-}O)_3(Me\text{-}TACN)_2](Cl)_2$; $[Mn^{IV}{}_2(\mu\text{—}O)_3(Me4\text{-}DTE)](PF_6)_2$; $[Mn^{IV}{}_2(\mu\text{-}O)_3(Me4\text{-}DTE)]Cl_2$; $[Mn^{IV}{}_2(\mu\text{-}O)_3(Me4\text{-}DTE)](SO_4)$; $[Mn^{IV}{}_2(\mu\text{-}O)_3(Me4\text{-}DTE)](OAc)_2$; 1,8-diethyl-1,4,8,11-tetraazacyclotetradecanemanganese(II) chloride and 1,4,8,11-tetraazacyclotetradecanemanganese(II) chloride.

9. A cogranule as claimed in claim 8, wherein the bleach catalyst is selected from the group consisting of: manganese acetate; manganese oxalate and $$[Mn^{IV}{}_2(\mu\text{-}O)_3(Me\text{-}TACN)_2](PF_6)_2.$$

* * * * *